United States Patent [19]

Raichle et al.

[11] 4,152,244

[45] May 1, 1979

[54] MANUFACTURE OF HYDROCARBON OILS BY HYDROCRACKING OF COAL

[76] Inventors: Ludwig Raichle, 12 Weinbietstrasse, 6703 Limburgerhof; Walter Kroenig, 7 Mathildenstrasse, 6200 Wiesbaden, both of Fed. Rep. of Germany

[21] Appl. No.: 854,374

[22] Filed: Nov. 23, 1977

[30] Foreign Application Priority Data

Dec. 2, 1976 [DE] Fed. Rep. of Germany ..... 2654635

[51] Int. Cl.[2] ..... C10G 1/00; C10G 1/06

[52] U.S. Cl. ..... 208/8 R; 208/10

[58] Field of Search ..... 208/8, 10

[56] References Cited

U.S. PATENT DOCUMENTS

| | | | |
|---|---|---|---|
| 2,913,388 | 11/1959 | Howell et al. | 208/10 |
| 3,075,912 | 1/1963 | Eastman et al. | 208/8 |
| 3,162,594 | 12/1964 | Gorin | 208/8 |
| 3,769,197 | 10/1973 | Leas et al. | 208/8 |
| 3,920,418 | 11/1975 | Rice | 208/8 |
| 3,997,424 | 12/1976 | Urquhart | 208/8 |
| 4,028,220 | 6/1977 | Urquhart | 208/8 |
| 4,036,731 | 7/1977 | Martin | 208/8 |
| 4,045,328 | 8/1977 | Green et al. | 208/8 |
| 4,048,054 | 9/1977 | Green et al. | 208/8 |
| 4,085,031 | 4/1978 | Walchuk | 208/8 LE |

*Primary Examiner*—Delbert E. Gantz
*Assistant Examiner*—William G. Wright
*Attorney, Agent, or Firm*—Keil & Witherspoon

[57] ABSTRACT

Production of hydrocarbon oils by hydrocracking of finely ground coal under pressure by slurrying the coal, optionally with a catalyst, in a mixture of middle and heavy oil produced by the process, and heating the slurry to 380°-440° C. together with hydrogen under 100-400 bars pressure, and then passing the mixture through one or more reaction chambers kept at 420°-490° C. The reaction products are passed to one or more hot separators, part of the gas and vapor thus separated being passed through one or more reaction chambers containing a fixed hydrogenation catalyst. The other part of the separated gas and vapor is cooled directly. The middle and heavy oil used for the slurry is in part middle and heavy oil derived from the directly cooled stream while the other portion is a distillate oil derived from the bottoms sludge of the hot separator.

7 Claims, 1 Drawing Figure

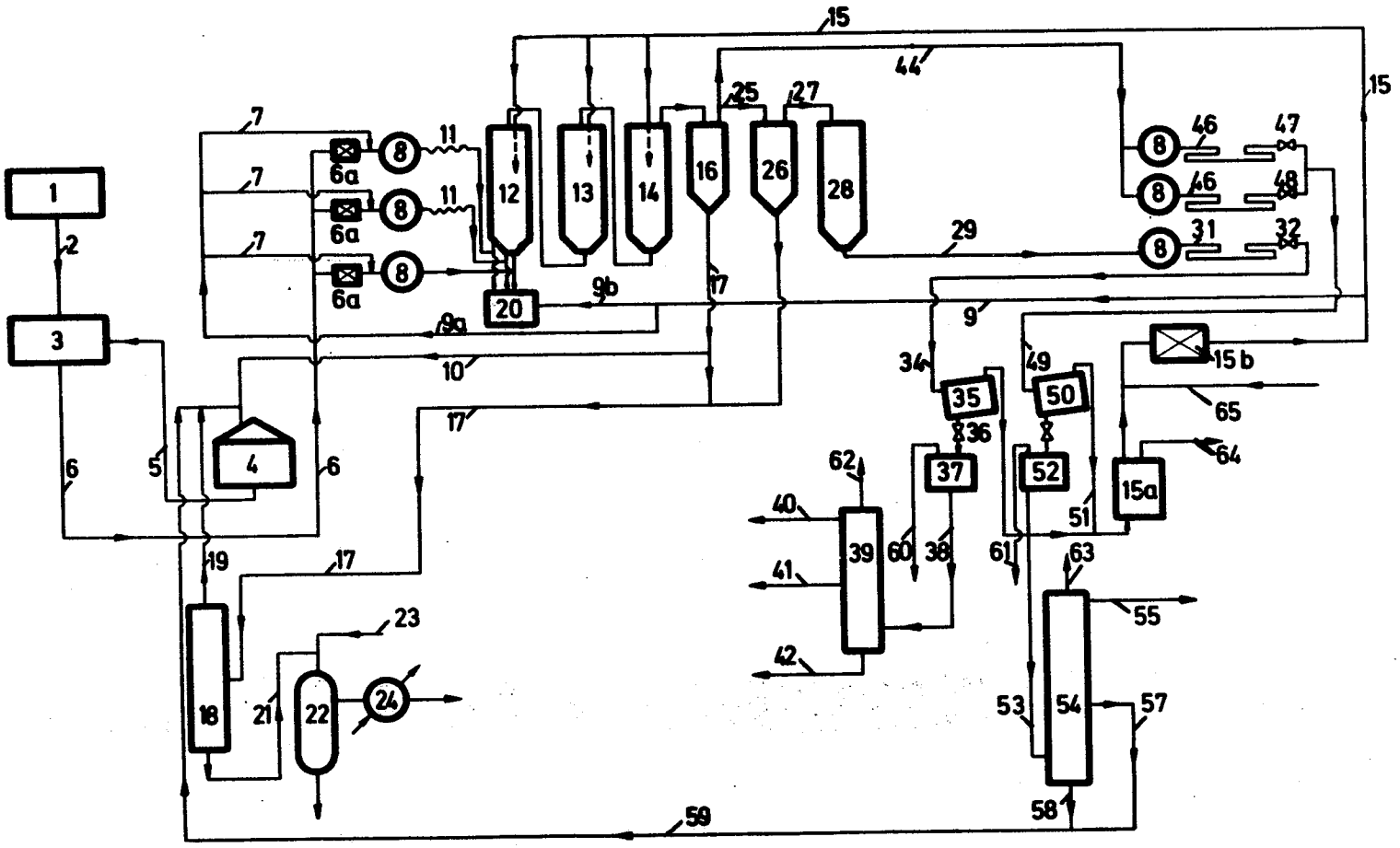

MANUFACTURE OF HYDROCARBON OILS BY HYDROCRACKING OF COAL

The conversion of coal into distillable products by hydrocracking under pressure in the liquid phase, advantageously in the presence of finely divided catalysts, and the further hydrogenation of these products in the gas phase or a mixed phase over a fixed catalyst, has been disclosed. In this process the hydrogenation mixture which leaves the reaction chamber is separated, in a hot separator downstream from the reaction chamber, on the one hand into gaseous products or products in vapor form, which are in turn separated or hydrogenated further, and on the other hand into a heavy oil which contains the asphaltenes and the solids, i.e. the unconverted coal, ash and any catalyst which has been added. This sludge is freed from the bulk of the solids by centrifuging. The oil centrifuged-off, which contains the asphaltenes and the solids which have not been separated off, is recycled to the hydrogenation process for slurrying the coal. The residue from the centrifuging operation is subjected to low-temperature carbonization, the oil obtained is added to the slurry oil and the residue, namely low-temperature coke and inorganic constituents, is removed. Using this method, the greater part of the asphaltenes formed by the hydrogenation of the coal is recycled with the slurry oil, so that the ease with which these asphaltenes can be hydrogenated has a critical influence on the course of the hydrogenation.

We have now found that hydrocarbon oils can be obtained continuously by hydrocracking of finely ground coal under pressure, in a substantially improved manner, by slurrying this coal, advantageously together with finely divided catalyst, with an oil mixture taken from the hydrogenation process, and heating the slurry, together with hydrogen under a pressure of from 100 to 400 bars, to from 380° to 440° C. and passing it through one or more reaction chambers kept at from about 420° to 490° C., if the starting material used in a substantially asphaltene-free mixture of middle oil and heavy oil, on the one hand, and coal, on the other, in the ratio of from 1:1 to 3:1, and the reaction products are passed into a hot separator kept somewhat below the reaction temperature, a part of the gases and vapors which leave the top of the separator are passed—if desired, via a second hot separator from which a small amount of high-boiling constituents and solids is withdrawn—through one or more reaction chambers provided with fixed hydrogenation catalysts, and, after cooling to from about 40° to 80° C., are passed into a stripper for removing hydrogen (recycle gas) and liquid hydrogenation products, another part of the gases and vapors from the hot separator is cooled directly and separated, in a stripper, into recycle gas and liquid products, the latter are freed from gasoline and then used as slurry oil for the coal, the bottom product (sludge) from the first hot separator is separated into a distillate oil for slurrying the coal and into a residue, and the latter is converted, in a gasifier under a pressure of from 30 to 100 bars, to give synthesis gas.

Accordingly, the essential concept of the invention is that an asphaltene-free oil is used for slurrying the coal and the coal hydrogenation product from the liquid phase, after leaving the first hot separator, is separated into three parts, namely a distillate stream, the liquid constituents of which correspond, in amount, to the liquid oil gain and are hydrogenated further, the remainder of the distillate stream, of which the middle oil and heavy oil constituents serve as part of the slurry oil, and the high-boiling residue of the hot separator (sludge), from which is obtained, by distillation, a distillate which serves as a component of the slurry oil, and a residue for gasification. If desired, a small part of the sludge can, with or without releasing the pressure, be recycled to the hydrogenation stage. By using this method it is possible to increase the throughput in the liquid phase, to manage with pressures of from 100 to 300 bars, to carry out the further hydrogenation of the liquid phase product directly, whilst utilizing the latent heat of the liquid phase product, and to convert the sludge, without polluting the environment, into easily handled gases and into ash (slag) which can be dumped.

Suitable starting materials are solid carbonaceous materials, for example coal, lignite or peat. These materials, which should have a mineral content of less than 10% and advantageously less then 5%, by weight, are advantageously mixed with from 0.5 to 5%, especially from 1 to 3%, by weight, of a finely divided catalytic substance, e.g. compounds of metals of groups 4, 6 and 8 of the periodic table, or of mixtures of these metals. The metal compounds may contain oxygen, sulfur, phosphorus or halogens. It is advantageous to spray the coal with salts or compounds, e.g. iron sulfate, in the form of a solution. When hydrogenating bituminous coal, in particular, it has proved useful to employ additives which are converted into hydrogen sulfide or hydrogen halide under the reaction conditions.

The dried coal is slurried with a distillate oil taken from the process, a mixture of middle oil and heavy oil, in a weight ratio of from about 1:1 to 1:3; advantageously, from 1.5 to 2.0 parts by weight of slurry oil are used per part by weight of maf coal. It is advantageous to add from about 10 to 40% by weight or even more (the percentages being based on the maf coal employed) of the bottom product, obtained from the hot separator, to the coal slurry before or during heating, with or without release of pressure. The coal slurry in then heated, together with the recycle hydrogen gas under a pressure of from 100 to 400, preferably 100 to 350, bars, to from 380° to 440° C., suitably by means of heat exchangers and a gas-heated preheater, and is passed through one or more reaction chambers arranged in series and kept at from 420° to 490° C. The entire amount of hydrogenation gas entering the system, that is to say recycle gas plus fresh hydrogen, generally amounts to from about 1,000 to 5,000 cubic meters (S.T.P.)/tonne of maf coal, and of this total gas a substantial part, from about 25 to 50%, is introduced as cold gas at suitable points of the reaction chamber, in order to counteract the heat of reaction and thus keep the reaction temperature constant. In general, the coal slurry and the recycle gas intended for the heating-up zone are heated up together. However, it can be advantageous to heat part of the gas by itself, to a higher temperature than that envisaged for preheating the slurry, and to add the super-heated gas before, in or after the preheater, advantageously in the vicinity of the point at which the coal slurry enters the reaction chamber, in order to cause the reaction to start rapidly.

The reaction products pass into a hot separator, the temperature of which is kept from about 10° to 50° C. below the reaction temperature. In the separator, the products are separated into the bottoms product (sludge) which is discharged at the bottom and which contains the high-boiling products, the asphaltenes, the unconverted coal, the inorganic constituents of the coal and any catalyst, and into the product, in the form of gas and vapor, which leaves overhead together with the recycle gas.

The amount of volatiles distilled from the sludge is suitably selected so that the residue left, namely the topped sludge, can still be pumped at down to about 150° C. In general, the solids content (benzene-insoluble matter) is adjusted to from about 40 to 60%, advantageously about 50%, by weight. The sludge may be thickened by flashing, vacuum distillation or a combination of both processes. For flashing, the sludge is let down, at a temperature near that of the hot separator, into a vessel, the flashing being effected by the gases liberated. The sludge can be let down in one or more stages, and a part of the flash gases which have been freed from the oil may or may not be recycled via a compressor and a heater. If the thickening of the sludge, achieved in this way, is to be taken further, additional oil can be driven off the flashed sludge in a vacuum distillation process. Alternatively, the sludge can be fed to the vacuum distillation directly after having been let down. The distillate from the sludge topping step is recycled to the hydrogenation for use as a part of the slurry oil mixture. The topped sludge is gasified in a generator, suitably by partial oxidation in the presence of steam at from about 1,100° to 1,500° C., to give a mixture of carbon oxides and hydrogen, which can be worked up in the conventional manner to obtain hydrogen gas. The mineral constituents introduced into the gasification process are in general removed as slag from the generator. If the amount of hydrogen obtained in this way is insufficient to provide the requirements of the coal hydrogenation stage, the degree of thickening can be reduced and the mixture made up with coal until the limit of pumpability is reached. Alternatively, if there is a deficiency of hydrogen, it is possible to supplement this by adding other carbonaceous materials, e.g. vacuum residues or propane asphalts from high-sulfur crudes, or tars from the gasification of coal, to the material in the generator.

The gases and vapors which leave the upper part of the hot separator are divided into two streams, of which one is fed to a hydrogenation reaction over a fixed catalyst and is then cooled and condensed, whilst the other is directly cooled and condensed. The part intended for hydrogenation is advantageously cooled by about 20° C. and then passed into a second hot separator in order to remove entrained heavy constituents (solids and asphaltenes). The small amount of constituents removed in this second separator can be added directly to the slurry oil or to the coal slurry. Instead of a second hot separator, it is possible to use a centrifugal separator ("hydroclone").

The amount intended for hydrogenation is advantageously such that it corresponds to the amount of distillate oil freshly formed from the coal in the liquid phase and hence corresponds to the amount of oil removed from the liquid phase oil circulation. It is in general from 20 to 40% of the total distillate oil from the hot separator. However, it is also possible to pass an amount of the distillate oil from the hot separator which is greater than the amount of liquid oil gain, for example up to about 80% of the total distillate oils, over the fixed hydrogenation catalyst and to recycle the distillate oil mixture which has been freed from gasoline and exceeds, in amount, the oil gain, into the slurry oil recycle system, together with the distillate oil which has not been passed over the fixed hydrogenation catalyst. By using this procedure, the ratio of hydrogenated to non-hydrogenated material in the slurry oil to be recycled can be adjusted in accordance with the requirements of the coal hydrogenation. It can be useful to employ any fractions of the distillate oil either as oil gain or as recycle oil.

The hydrogenation can be carried out as a hydrocracking or hydrorefining step. In can be advantageous again to subdivide the distillate oil intended for the fixed bed hydrogenation and then to pass it, in separate streams, over hydrogenation reactors connected in parallel. Advantageously, hydrocracking conditions are selected for the part corresponding to the oil gain and hydrorefining conditions for the other part. In this way, the properties of the hydrogenation products can be adjusted to suit the further use of the products. Suitable hydrogenation catalysts are oxides, sulfides or phosphates of metals of groups 6 and 8, for example molybdenum or tungsten, which may or may not be mixed with oxides or sulfides of metals of the iron group. Further suitable hydrogenation catalysts are platinum and rhenium, advantageously in the form of the metal, or mixtures of these. The above metals, advantageously as a solution of appropriate compounds are applied to the carrier, in amounts of from 3 to 15% in the case of the compounds mentioned and in amounts of from 0.2 to 2% in the case of platinum and rhenium. Suitable carriers for hydrorefining are aluminum oxide and its spinels, as well as titanium oxide, zirconium oxide, magnesium oxide and the like, whilst suitable carriers for hydrocracking are natural and synthetic bleaching earths, advantageously activated with hydrofluoric acid, and especially zeolites. Suitable shapes of catalyst are spheres, rings (Raschig rings), cones or cylinders.

Suitable temperatures are from 420° to 480° C. for hydrocracking and from 340° to 420° C. for hydrorefining.

The hydrogenation products are cooled and passed into a vessel (stripper) where they are separated into condensate and gas. The distribution between the streams of gases and vapors which leave the hot separator is effected by regulating the amounts of gas which leave the stripper. However, it may be more advantageous to separate the streams immediately downstream from the hot separators. The gas taken off the strippers advantageously passes through an oil wash and is then recycled to the hydrogenation. The condensates from the strippers are separated, in distillation columns, into gasoline, middle oil and heavy oil. The entire gasoline from all the streams is processed further to give motor gasoline or chemical raw materials. The middle oil and heavy oil taken from the stream of oil gain are processed further, whilst the middle oil and heavy oil from the other streams are recycled, as slurry oil, to the coal hydrogenation process. It can, however, be more advantageous to isolate the gasoline from the hydrogenation streams by fractional condensation and to divide up the higher-boiling constituents further and then utilize them on the one hand as a slurry oil component and on the other hand, as part of the oil gain, for further hydrogenation.

EXAMPLE 1

100 tonnes of finely ground Ruhr coal (calculated as 100 tonnes of maf coal) are mixed with 1.2% of $FeSO_4.7H_2O$ + 2% of Bayermasse and 0.3% of $Na_2S$ as the catalyst. Bayermasse is a trademark for a known residue obtained in the treatment of bauxite with soda ash, its reported composition being 48.6% $Fe_2O_3$, 20% $Al_2O_3$, 9.2% $SiO_2$, 6.0% $TiO_2$, 0.2% $MnO_2$, 1.2% CaO, 0.5% MgO, 6.2% $Na_2O$, 0.2% $K_2O$ and 13–15% $H_2O$. Ullmann, 1958, vol. 10, p. 499. From vessel 1, the coal passes through line 2 into vessel 3. There, the coal is mixed with 190 tonnes of a mixture, consisting of middle oil and heavy oil, which is supplied from vessel 4 through line 5. Through line 6, 292 tonnes of coal slurry are passed to the three presses 6 *a*, where the slurry is subjected to 300 atmospheres. It is then combined with 30 tonnes of recycle gas which is also under 300 atmospheres and divided over the three feed lines 7. The reaction mixture passes through the three heat exchangers 8 and the two gas-heated preheaters 11, in which it is heated to 420° C, into the three reaction vessels 12, 13 and 14, which are connected in series and have a total capacity of 130 cubic meters. From the hydrogenating gas circulation under 300 atmospheres pressure, 50 tonnes of recycle gas are branched off line 15 via line 9, with 30 tonnes flowing through line 9 *a* to the three lines 7 and 20 tonnes passing through line 9 *b* into the preheater 20, where they are heated to 430° and passed into the first reaction vessel 12. A further part-stream of the recycle gas, amounting to 27 tonnes, is taken from line 15 and divided over the three reaction vessels in order to regulate the temperature. The reaction temperature in the vessels is 480° C. 369 tonnes of reaction product enter the first hot separator 16, which is at 450°. At the lower end thereof, 65 tonnes of a high-boiling product are taken off through line 17. 20 tonnes are fed to the slurry oil vessel 4 through line 10, whilst the remaining 45 tonnes pass into the vacuum distillation column 18. Through line 19, 20 tonnes of heavy oil flow to the slurry oil vessel 4. 27 tonnes of residue are taken off at the bottom of the column and are fed through line 21 to the pressure gasification unit 22. Using 17 tonnes of oxygen supplied through line 23, a synthesis gas is produced from which hydrogen is obtained by shift conversion and is fed to the hydrogenating gas circulation. In the heat exchanger 24, high pressure steam under 100 atmospheres is generated; this is required to drive the turbomachine 15 *b* which keeps the recycle gas and the fresh hydrogen at the operating pressure of 300 atmospheres.

A total of 304 tonnes leave the upper end of the first hot separator 16. Of this amount, 74 tonnes are passed through line 25 to the second hot separator 26, which is at 450°. At the lower end of the separator, 2 tonnes are taken off and passed to the vacuum distillation column 18, whilst 72 tonnes of a product consisting of gasoline, middle oil and heavy oil, from the upper end, are passed through line 27 to a reaction vessel 28 provided with a fixed caatalyst. The catalyst consists of an aluminum silicate carrier provided with molybdenum/cobalt-/nickel sulfide. 72 tonnes of the reaction product, at 450°, pass via line 29, heat exchanger 8, water cooler 31, regulating valve 32 and line 34 into the stripper 35, which is at 50°. In this, 19 tonnes of recycle gas are separated off and pass via a gas wash 15 a into the pipe system 15, whilst the liquid is passed through line 36, via a let-down valve, into vessel 37. The pressure is 50 atmospheres. This liberates 3 tonnes of hydrogenating gas, which are taken off through line 60. The liquid passes through line 38 into the distillation column 39, where it is separated by distillation. 5 tonnes of light hydrocarbons and gasoline are obtained from line 40 and 21 tonnes of middle oil from line 41, whilst at the end of the column, 23 tonnes of heavy oil are discharged through line 42.

The remainder of the product leaving the first hot separator 16, namely 230 tonnes, is passed through line 44 via the two heat exchangers 8, the two water coolers 46, regulating valves 47 and 48 and line 49, into the stripper 50.

The amount which is respectively subjected to catalytic hydrogenation under pressure or passed directly to the distillation can be regulated by means of the valves 32, 47 and 48.

55 tonnes of recycle gas leave the stripper 50 through line 51 and pass via the wash 15 a into the pipe system 15. 175 tonnes of liquid from the stripper are let down to 50 atmospheres and pass into the vessel 52. This liberates 7 tonnes of hydrogenating gas, which are removed through line 61. The liquid is passed via line 53 into the distillation column 54, where it is separated by distillation. 15 tonnes of light hydrocarbons (of 3 or 4 carbon atoms) and gasoline are removed through line 55, 60 tonnes of middle oil through line 57 and 90 tonnes of heavy oil through line 58. The latter are fed through line 59 to the slurry oil vessel 4.

3 tonnes and 7 tonnes of hydrogenating gas leave the letdown vessels 37 and 52 through lines 60 and 61. In addition, 1 tonne of hydrogenating gas is obtained from distillation 39 through line 62, 3 tonnes from distillation 54 through line 63 and 2.5 tonnes from gas wash 15 a through line 64, so that a total of 16.5 tonnes of hydrogenating gas are obtained.

5.5 tonnes of fresh hydrogen are added to the hydrogenation circulation in the pipe system 15 through line 65.

EXAMPLE 2

117 tonnes/day of hard coal in which the crude coal contains 10% of water, and the dry coal contains 5% of ash, so that the above amount corresponds to 100 tonnes/day of waf coal are mixed with 1.2 tonnes per day of $FeSO_4.7\ H_2O$ and 2 tonnes per day of Bayermasse, and the mixture is milled dry and stirred with a distillate oil mixture, comprising 60 tonnes per day of middle oil (200°–325° C.) and 110 tonnes per day of heavy oil (325°–450° C.), to give a slurry to which 0.3 tonne per day of sodium sulfide is added. The slurry is brought to the working pressure of 225 bars by means of a slurry press and is then mixed with 20 tonner per day of sludge (recycle sludge) which is supplied, without lowering the pressure or temperature, from the bottom of the hot separator. The slurry, together with 15,000 cubic meters (S.T.P.)/h of recycle gas, containing 80% by volume of hydrogen, is heated to 430° C. by means of a heat exchanger and a preheater and is introduced into a reactor of 7.5 cubic meters capacity, where the hydrogenation is carried out at 465° C. From the reactor, the reactants pass into a hot separator, where they are separated at 430° C. into a bottom product (sludge) on the one hand and, on the other hand, the gases and vapors which leave the upper part of the separator.

The amounts of gas which leave the cold strippers, downstream from cooling and condensation, are regulated so that 37.4% of the gases and vapors (stream I) directly enter the cooling route whilst 62.6% are passed on into a hydroclone, kept at 410° C., in which 9 tonnes per day of heavy oil are separated off centrifugally; this oil is returned, without lowering the pressure or temperature, into the preheater. The gases and vapors which leave the hydroclone are further divided, as described above, into 37.4% (stream II) and 25.2% (stream III), and these streams are now separately subjected to hydrogenation over fixed catalysts, stream III at 430° C. over cobalt molybdate on aluminum silicate and stream II at 370° C. over cobalt molybdate on aluminum oxide. The hydrogenated streams are cooled separately and condensed in separate strippers.

48.4 tonnes per day of sludge are taken off the bottom of the hot separator and let down into a vacuum distillation unit, from which are obtained 19.3 tonnes per day of distillate, which is used as slurry oil, and 29.1 tonnes per day of topped sludge, which is gasified with steam and oxygen at 1,300° C. under 80 bars pressure to form hydrogen via synthesis gas. The inorganic constituents introduced into the gasification are removed as slag.

The condensates obtained from streams I, II and III in the strippers are distilled separately. For clearer characterization, the amounts available are listed separately, showing the propertions originating directly from the coal phase (described as "non-hydrogenated") and those which have been passed over the fixed catalysts (described as "hydrogenated").

| | tonnes per day | | | | | |
|---|---|---|---|---|---|---|
| | slurry oil | | oil gain | | | |
| Product | heavy oil | middle oil | heavy oil | middle oil | gasoline | total |
| non-hydrogenated | 42.2 | 29.2 | — | — | 4.1 | 4.1 |
| hydrogenated | 48.7 | 30.8 | 10.0 | 23.8 | 10.2 | 44.0 |
| total | 90.7 | 60.0 | 10.0 | 23.8 | 14.3 | 48.1 |
| add: oil from sludge distillation | 19.3 | | | | | |
| total | 110.0 | | | | | |

In addition, 21 tonnes per day of gaseous hydrocarbons of 1 to 4 carbon atoms are obtained. The hydrogen which is chemically bonded is 6.5 tonnes per day.

For easier appreciation of the course of the process, the embodiment in which the separation into three streams is effected by regulating the amounts of gas which leave the three cold strippers has been described. However, when the process is operated industrially it can be more advantageous to regulate the streams in the hot part instead. The gases and vapors which leave the first hot separator are separated by slide valves or other suitable regulating means into stream I for passing on to the cooling zone and streams II+III together, which pass into the second hot separator or hydroclone. Downstream from this separator, the two streams are separated in order to include them into the two fixed bed hydrogenation reactors. If it is intended to hydrogenate the two streams under identical conditions, the separation is only effected downstream from the hydrogenation reactors. Downstream from the hydrogenation, stream II together with stream I is fed into the top of the hot heat exchanger (regenerator I) and the two streams pass conjointly through the stage of subsequent cooling and condensation in a common cold stripper. The gasoline is removed from the stripper product by distillation whilst the residue serves as slurry oil. However, it is also possible to fractionally condense the hydrogenation products along the cooling path, to obtain gasoline and slurry oil. Stream III passes through a separate part of the heat exchangers and coolers to a second cold stripper.

The non-hydrogenated gasoline is hydrorefined with intermediate led-down gas, under 50 bars, from the coal hydrogenation system. The total amount of gasoline thus obtained is passed to a catalytic reforming unit; the middle oil and heavy oil from the oil gain are converted to gasoline in the conventional manner by catalytic gas phase hydrocracking.

We claim:

1. A process for the continuous manufacture of hydrocarbon oil from coal by hydrocracking under pressure, by slurrying ground coal, with or without a catalyst, in an oil mixture which is produced as defined below, heating the slurry together with hydrogen under a pressure of from 100 to 400 bars to from 380° to 440° C., and passing it through one or more reaction chambers kept at from 420° to 490° C., wherein the ground coal is slurried in a virtually asphalt-free mixture of middle oil and heavy oil produced as defined below in a weight ratio of oil mixture coal of from 1:1 to 3:1, and the reaction products from the one or final reaction chamber are passed into a hot separator kept somewhat below the reaction temperature, the gas and vapor which leaves the top of the separator is divided into two parts having the same composition and a first part is passed through one or more reaction chambers provided with a fixed hydrogenation catalyst, and, after cooling to from 40° to 80° C., is passed into a stripper for separating hydrogen (recycle gas) and liquid hydrogenation product, the other part of said gas and vapor from the hot separator is cooled directly and separated, in a stripper, into recycle gas and liquid product, the latter is freed from gasoline and used as one portion of the slurry oil for the coal as specified above, a bottoms product (sludge) from the first hot separator is separated into a distillate oil to serve as the other portion of the slurry oil for pasting the coal and into a residue, and the latter is converted, in a gasifier under a pressure of from 30 to 100 bars, to give synthesis gas.

2. A process as claimed in claim 1, wherein the amount of said first part of the gas and vapor from the hot separator corresponds to the liquid hydrocarbon oil gain resulting from the hydrogenation of the coal.

3. A process as claimed in claim 1, wherein an amount of the gas and vapor from the hot separator which is greater than the amount specified in claim 2 is passed over the fixed hydrogenating catalyst and the proportion of the hydrogenation product which exceeds the oil gain is employed, after stripping off the gasoline, as a slurry oil component.

4. A process as claimed in claim 1, wherein in the gas phase hydrogenation, said first part of said gas and vapor corresponds to the liquid oil gain resulting from the hydrogenation of the coal and is subjected to hydrocracking, and said other part is hydrorefined and used as slurry oil.

5. A process as claimed in claim 1, wherein 10 to 40% by weight, based on maf coal employed, of said bottoms product taken from the hot separator is added to the coal slurry.

6. A process as claimed in claim 1, wherein a part of the recycle gas is heated to a higher temperature than that of the preheated coal slurry/gas mixture and the resulting superheated gas is introduced into said mixture.

7. A process as claimed in claim 1, wherein said gasification of the residue is carried out by partial oxidation in the presence of steam for the purpose of increasing the amount of hydrogen produced, and carbonaceous substances of the group consisting of coal, tar residues and petroleum residues are introduced into the residue to be gasified.

* * * * *